United States Patent [19]

Jones

[11] Patent Number: 4,927,015

[45] Date of Patent: May 22, 1990

[54] LUMINOUS GOLF BALLS AND CARRYING CASE THEREFOR

[76] Inventor: John S. Jones, 3729 N. Frontage Rd., Lakeland, Fla. 33804

[21] Appl. No.: 369,378

[22] Filed: Jun. 21, 1989

[51] Int. Cl.[5] ..... B65D 85/00

[52] U.S. Cl. ..... 206/315.9; 206/579; 206/315.1; 362/154; 362/156; 362/157; 312/223

[58] Field of Search ..... 206/315.1, 315.9, 372, 206/373, 375, 576, 579, 581; 362/20, 154, 155, 157; 312/223; 373/62, 87 R

[56] References Cited

U.S. PATENT DOCUMENTS

| | | | |
|---|---|---|---|
| 712,112 | 10/1902 | Arnold | 362/155 |
| 1,293,187 | 2/1919 | Peters | 362/154 |
| 2,344,800 | 3/1944 | Butcher | 312/223 |
| 3,381,120 | 4/1968 | Fleisher et al. | 312/223 |
| 3,831,001 | 8/1974 | Toomey et al. | 273/62 |
| 3,937,320 | 2/1976 | Chao et al. | 362/155 |
| 3,938,132 | 2/1976 | Cunningham | 362/154 |
| 4,281,365 | 7/1981 | Elving et al. | 362/20 |
| 4,481,562 | 11/1984 | Hickson | 362/157 |
| 4,574,944 | 3/1986 | Gregory | 206/581 |
| 4,577,262 | 3/1986 | Buteaux | 362/154 |
| 4,591,051 | 5/1986 | Lowman | 206/579 |
| 4,754,376 | 6/1988 | Winslow | 362/154 |
| 4,816,970 | 3/1989 | Garcia, Jr. | 362/157 |

FOREIGN PATENT DOCUMENTS

| | | | |
|---|---|---|---|
| 465303 | 8/1951 | Italy | 362/154 |

OTHER PUBLICATIONS

Boxboard Containers vol. 94 No. 1 Aug. 1986 p. 31.

*Primary Examiner*—David T. Fidei

*Attorney, Agent, or Firm*—Ronald E. Smith; Joseph C. Mason

[57] ABSTRACT

Luminescent golf balls and a carrying case. A luminous substance having a radiant color is mixed into a soltuion of compounds used to produce golf ball covers so that when the cover has been completed, it is impregnated with the luminous substance. An octagonal carrying case has a false bottom that divides the case into an upper chamber and a lower chamber. The upper chamber is lined with a light-reflective material. A single layer of golf balls and a light source are disposed in the upper chamber of the case and a first power supply for the light source is disposed in the lower chamber. Solar panels on the lid of the case provide an alternative power supply.

18 Claims, 2 Drawing Sheets

Fig. 1
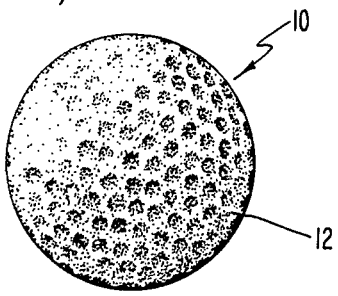
Fig. 4
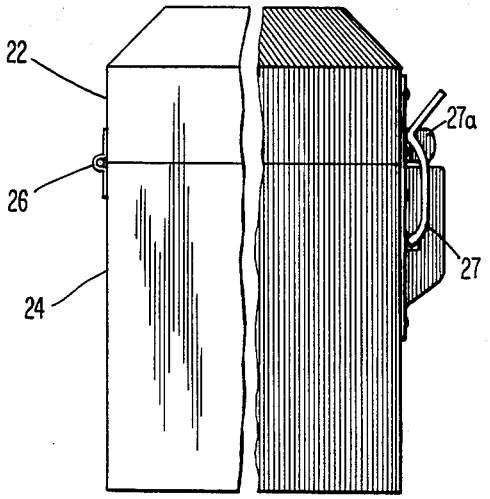
Fig. 2
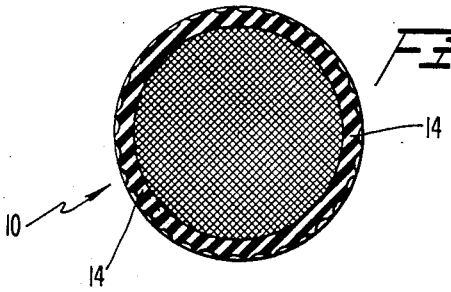
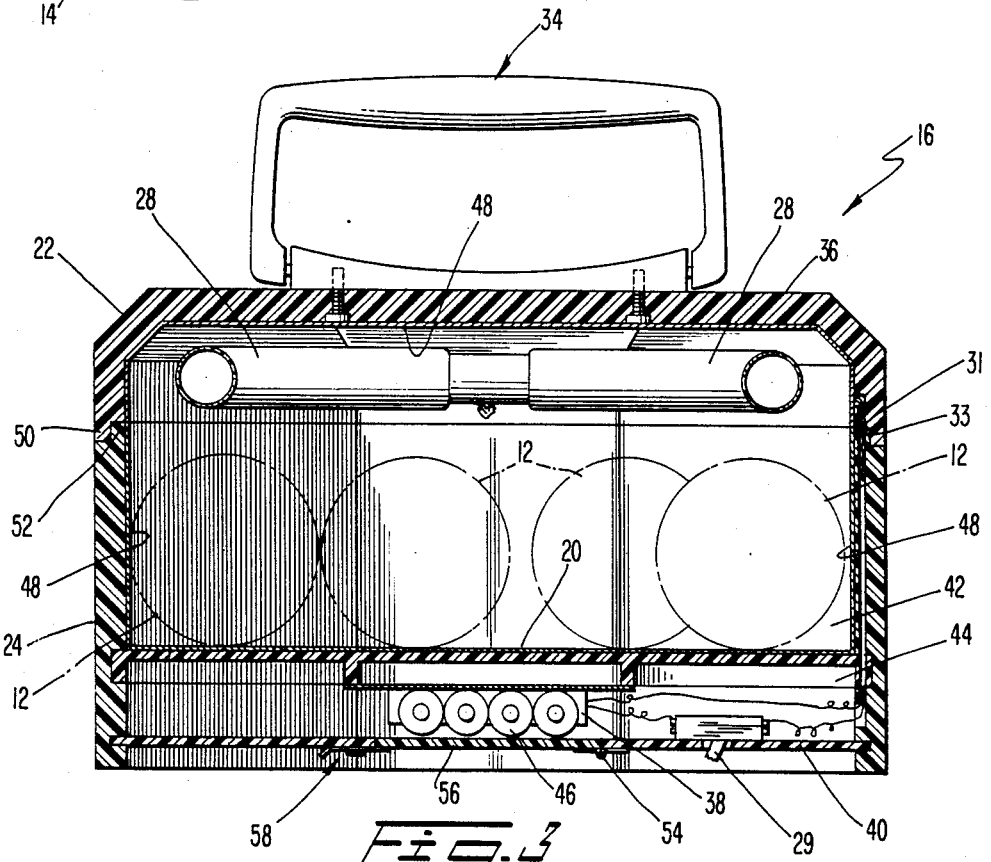
Fig. 3

18
27a
50
16
32
28
31
30
22
26
54
29
38
52
24
12
20
33
48
27

LUMINOUS GOLF BALLS AND CARRYING CASE THEREFOR

TECHNICAL FIELD

This invention relates to a luminous golf ball cover impregnated with a material containing phosphorous or phosphorogens so that the golf ball can be seen at night; it also relates to a carrying case that bathes a plurality of the novel golf balls in light.

BACKGROUND ART

Japanese Pat. No. 61-176369 discloses a golf ball impregnated with a light-accumulating pigment containing zinc and sulfur so that the balls may be used in night games.

U.S. Pat. No. 3,938,132 to Cunningham discloses a light-containing carrying case having a handle, a battery for power, and a reflector inside the case. A handle is used for carrying the case, and batteries power the light which is constructed and positioned to illuminate the interior of the case, including its contents, and a reflector plate is preferably provided at a location over the light to reflect the light and direct the light downwardly into the case.

U.S. Pat. No. 4,591,051 to Lowmann discloses a ball containing carrying case having a handle for carrying balls that are stacked up to five balls in height and five balls in width. The cover is transparent so that the balls are clearly visible from the outside of the case. U.S. Pat. Nos. 4,779,725 to Gerber, 2,883,207 to Reich, 3,918,719 to Welch and 3,917,264 to Davidson et al. are also of interest.

DISCLOSURE OF INVENTION

A luminous substance is impregnated into the cover of a golf ball, golf tee, ball marker or other related items, at the time the item is manufactured.

A plurality of balls are carried in a carrying case having at least one battery powered fluorescent light bulb therein. A false bottom divides the carrying case into an upper chamber and a lower chamber. The balls and the light source are in the upper chamber whereas the battery pack for the light source is disposed in the lower chamber. Solar panels that generate electricity for the light source are mounted on the lid of the case.

The interior of the upper chamber is lined with a reflective foil to disperse light from the bulb or bulbs throughout the interior of the upper chamber of the carrying case. The balls are disposed in the upper chamber in a single layer to insure that each ball is bathed in light emitted from the light source.

The luminous substance is excited or activated when exposed to light. Thus, when a ball or other item is placed into the carrying case and the light source is activated, the luminous material is excited.

The luminous material of this invention is phosphorescent; it glows in the dark for extended periods of time after being removed from the carrying case or other source of light and is repeatedly rechargeable.

An important object of this invention is to provide luminescent golf balls and related items so that said items are visible under low light conditions.

Another important object is to provide carrying cases for luminescent items that include light sources so that said items are recharged when stored in said cases.

The invention accordingly comprises the features of construction, combination of elements and arrangement of parts that will be exemplified in the construction set forth hereinafter and the scope of the invention will be set forth in the claims.

DESCRIPTION OF THE DRAWINGS

For a fuller understanding of the nature and objects of the invention, reference should be made to the following detailed description, taken in connection with the accompanying drawings, in which:

FIG. 1 is an elevational view of a luminescent golf ball;

FIG. 2 is a cross sectional view of the golf ball of FIG. 1;

FIG. 3 is a transverse sectional view of a carrying case for golf balls;

FIG. 4 is a fragmented side elevational view of the novel carrying case;

Similar reference numerals refer to similar parts throughout the several views of the drawings.

BEST MODES FOR CARRYING OUT THE INVENTION

Figures 5, 6:
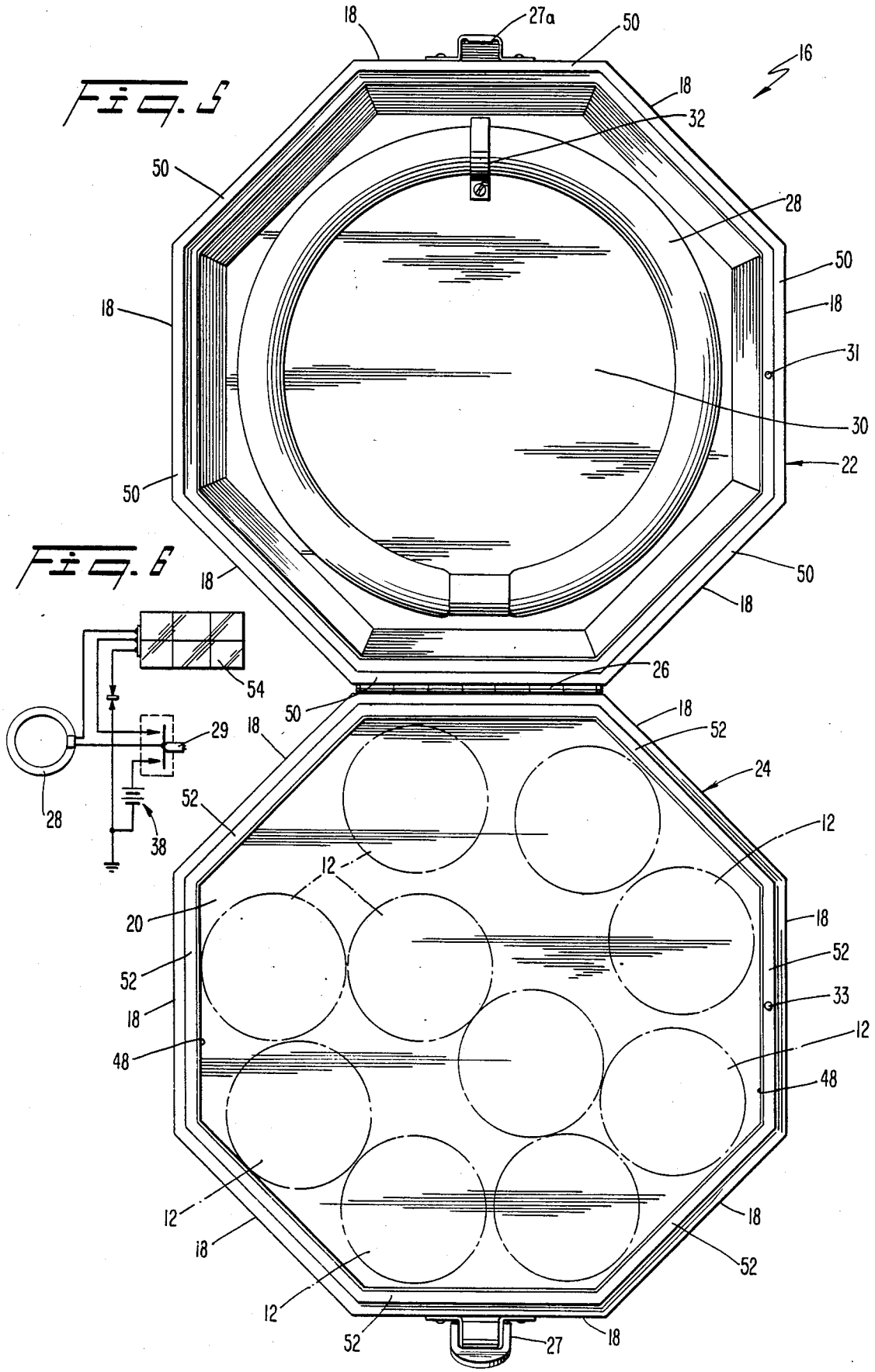
FIG. 5 is a plan view of the case in its open configuration.
FIG. 6 is a schematic wiring diagram of a solar unit that supplies power to the lamp.

Referring now to FIGS. 1 and 2, it will there be seen that a golf ball treated with a luminous substance is denoted as a whole by the reference numeral 10. It should be noted at the outset, however, that other items such as golf tees and ball locators, for example, could also be treated with a luminous substance in accordance with the teachings and suggestions of this invention.

The luminous substance is mixed with a radiant pigment and the mixture is thereafter impregnated into the cover 12 of ball 10. The impregnation is performed at the time the ball cover is manufactured, i.e., the mixture of radiant pigment and luminous substance is placed into the mixture that produces the cover.

A minute amount of the pigment/luminous substance is required to produce the ball of FIGS. 1 and 2. It has been found that of the total constituents of the cover, only 0001-0.01 percent of said constituents need be the pigment/substance mixture to produce the luminescent golf balls of this invention.

FIG. 2 depicts a plurality of particles of the pigmented luminous substance. The particles are collectively denoted 14.

The preferred luminescent substance of this invention is a phosphorescent substance such as an inorganic zinc sulfide phosphor. Any material containing phosphorous or phosphorogens is suitable.

The preferred carrying case is shown in plan view in FIG. 5 and is denoted 16, generally. Although carrying case 16 is shown in octagonal form, having eight sides collectively denoted 18, it could be provided in different geometrical configurations.

Case 16 carries up to ten balls 12 as depicted in FIG. 5. The balls are not stacked atop one another but are disposed in a single layer. The floor 20 of case 16 that supports balls 12 is a false floor as will become clear as this description proceeds.

Case 16 includes a lid 22 and a base 24 that are hingedly connected to one another by hinge 26. An annular fluorescent light bulb 28 is secured to the inside wall 30 of lid 22 by clip 32. Pivotally mounted latch 27 on base 24 and latch base **27*a* on lid 18 hold the lid closed when desired. Switch 29 (FIG. 3) is an on-off switch for bulb 28** and for the solar unit as hereinafter described.

As shown in FIG. 3, a handle 34 is pivotally secured as illustrated or by other suitable fastening means to top exterior wall 36 of lid 22 to facilitate carrying of the case.

The golf balls 12 are supported on the above-mentioned false bottom 20 of the case; a battery pack 38 is mounted below the false floor 20 atop the true bottom wall 40 of the case 16. Thus, false bottom 20 divides the base 24 of carrying case 16 into an upper chamber 42 and a lower chamber 44 as shown.

Battery pack 38, having a plurality of batteries, collectively denoted 46 therein, is conductively coupled to a fluorescent light bulb 28. The light bulb 28 is positioned above the balls 12 as shown, in the upper chamber 42 of the case. Any other source of visible light, ultraviolet light or other suitable sources of electromagnetic radiation may be employed. Metal contacts 31, 33, best shown in FIG. 5, complete the electrical circuit between bulb 28 and batteries 46 so that when lid 22 is open, no current can flow to bulb 28.

The inside walls of the upper chamber 42 of case 16 are lined with a light-reflective foil denoted 48, generally. The lower chamber 44 is not so lined. The foil effectively bathes each ball 12 in light since the balls are not stacked atop one another. Moreover, by positioning the battery power pack in the lower chamber 44, there is nothing in the upper chamber 42 to obstruct the light from bulb 28, thereby insuring that each ball 12 is fully illuminated whenever the light source 28 is activated.

True bottom wall 40 is recessed with respect to the bottom of case 16 as shown in FIG. 3 to accommodate hinge 54 of battery pack access door 56 and door opening means 58.

To make the interior of case 16 substantially light tight, lid 22 and base 24 have complementally formed edges that interlock with one another. For example, lid 22 may be provided with a downwardly depending flange 50 at its radially outermost edge as depicted in FIGS. 3 & 5, and base 24 may be provided with an upwardly projecting flange 52 that mates therewith when the lid is closed as clearly shown in FIG. 3.

FIG. 4 further depicts the hinged interconnection between base 24 and lid 22 and shows the closed position of latch 27 and its base **27*a*** as well.

FIG. 6 shows a solar panel unit 54 that is conductively coupled to lamp 28; unit 54 is mounted on top of lid 22. Switch 29 is a double throw switch so that power can be drawn from battery pack 38 or solar unit 54 at the election of the user.

A commercial embodiment of the present invention employs Spot-Lite (trademark) phosphorescent materials available from Hanovia Corporation of Newark, N.J., a subsidiary of Canrad Inc. Specifically, the preferred phosphorescent material is Hanover's Glow-in-the-Dark (Glo) pigment Series 1000.

When one or more of the balls 12 are removed from case 16, it will glow brightly in the dark for an extended period of time. The intensity of the glow will diminish with time, but the luminescence will still be detectable by dark-adapted eyes for many hours thereafter.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A carrying case for a luminescent golf ball, comprising:

a hollow case member of predetermined geometrical configuration and dimension;

a light-reflective material disposed in overlying relation to interior walls of said case member;

at least one light source disposed within said case member;

a power means for said at least one light source;

said power means being disposed within said case member; and at least one luminescent golf ball being carried in said case member so that said light source activates luminescent material in said golf ball.

2. The carrying case of claim 1, further comprising a false bottom wall being disposed within said case member, said power means for said light source being positioned below said false bottom wall and at least one golf ball being supported atop said false bottom wall.

3. The carrying case of claim 2, wherein said false bottom wall divides the interior of said case into an upper chamber and a lower chamber, and wherein said light-reflective material overlies interior walls of said upper chamber.

4. The carrying case of claim 3, further comprising a single layer of luminescent golf balls being disposed in said case member so that each ball is exposed to light from said light source.

5. The carrying case of claim 4, wherein said case member is octagonal in configuration.

6. A carrying case means for golf balls comprising:

a case member having a hollow interior;

a case member having a false bottom;

said false bottom dividing said hollow interior into an upper chamber and a lower chamber;

a source of electromagnetic radiation being disposed in said upper chamber;

a first source of power, for activating said source of electromagnetic radiation, being disposed within said lower chamber;

said upper chamber being lined with a radiation-reflecting means;

a plurality of luminescent golf ball members being disposed in said upper chamber;

said luminescent golf bal members being supported by said false bottom; and said luminescent golf ball members being disposed in a single layer so that each ball is bathed in electromagnetic radiation emitted by said source of electromagnetic radiation.

7. The carrying case of claim 6, wherein said carrying case further comprise a lid member that is hingedly connected to a base member.

8. The carrying case of claim 7, wherein said source of electromagnetic radiation is fixedly secured to an underside of said lid member.

9. The carrying case of claim 8, wherein said lid member and said base member interlock with another at their respective outermost edges to form a substantially light impervious seal.

10. The carrying case of claim 9, further comprising a true bottom wall disposed below said first source of power.

11. The carrying case of claim 10, wherein said first source of power is a battery pack.

12. The carrying case of claim 11, further comprising a door means formed in said true bottom wall to provide access to said battery pack.

13. The carrying case of claim 12, wherein said true bottom wall is recessed with respect to a lowermost edge of said base wall to accommodate said door means.

14. The carrying case of claim 8, further comprising means for deactivating said source of electromagnetic radiation when said lid member is open.

15. The carrying case of claim 14, further comprising a second source of power for activating said source of electromagnetic radiation.

16. The carrying case of claim 15, wherein said second source of power is a solar panel means mounted on the top of said lid member.

17. The carrying case of claim 16, further comprising a switch means for activating said source of electromagnetic radiation.

18. The carrying case of claim 17, wherein a first position of said switch means conductively couples said source of electromagnetic radiation and said battery pack and wherein a second position of said switch means conductively couples said source of electromagnetic radiation and said solar panel means.

* * * * *